US006493451B2

(12) United States Patent
Paritsky et al.

(10) Patent No.: US 6,493,451 B2
(45) Date of Patent: Dec. 10, 2002

(54) COMMUNICATION HELMET

(75) Inventors: Alexander Paritsky, Modiin (IL); Alexander Kots, Ashdod (IL); Kazuo Takahashi, Tokyo (JP); Okihiro Kobayashi, Tokyo (JP)

(73) Assignee: Phone-Or Ltd., Or-Yehuda (IL)

( * ) Notice: Subject to any disclaimer, the term of this patent is extended or adjusted under 35 U.S.C. 154(b) by 0 days.

(21) Appl. No.: 09/882,762

(22) Filed: Jun. 15, 2001

(65) Prior Publication Data

US 2002/0085727 A1 Jul. 4, 2002

(51) Int. Cl.[7] ..... H04R 25/00
(52) U.S. Cl. ..... 381/172; 381/367
(58) Field of Search ..... 381/172; 359/150, 359/151, 172, 149, 173, 179, 191, 361, 356, 357, 367

(56) References Cited

U.S. PATENT DOCUMENTS 1,242,672 A * 10/1917 Finley
2,666,650 A * 1/1954 MacDonell ..... 381/172
2,950,360 A * 8/1960 Duncan
3,286,032 A * 11/1966 Baum ..... 381/172
3,314,424 A * 4/1967 Berman
3,611,277 A * 10/1971 Yoder ..... 381/172
4,479,265 A * 10/1984 Muscatell ..... 455/605
4,833,726 A * 5/1989 Shinoda et al. ..... 455/89
5,969,838 A * 10/1999 Paritsky et al. ..... 359/150

FOREIGN PATENT DOCUMENTS

| | | |
|---|---|---|
| JP | 48-15065 | 4/1973 |
| JP | 58-96499 | 6/1983 |
| JP | 58-144986 | 9/1983 |

* cited by examiner

*Primary Examiner*—Sinh Tran
(74) *Attorney, Agent, or Firm*—Townsend and Townsend and Crew LLP

(57) ABSTRACT

A communication helmet having an enhanced noise reduction effect. The communication helmet incorporates a microphone disposed in the vicinity of the mouth of the speaker wearing the helmet. The microphone is an optical microphone comprising a diaphragm (31) vibrating with sound pressure, a case (40) containing the diaphragm (31) and having a first opening (38) and a second opening (39) open in symmetric positions and facing the diaphragm (31), a light source (32) for projecting a light beam to the diaphragm (31), and a photodetector (35) receiving part of the reflected light of the light beam projected to the diaphragm (31) and outputting a signal corresponding to the vibration of the diaphragm (31). The optical microphone is fixed to a fixing base (250) at a predetermined angle so that the incoming sound wave may uniformly enter the first opening (38) and the second opening (39). The fixing base (250) is attached to the helmet with a space so that the external sound wave may uniformly enter the first opening (38) and the second opening (39).

2 Claims, 5 Drawing Sheets

FIG. 1
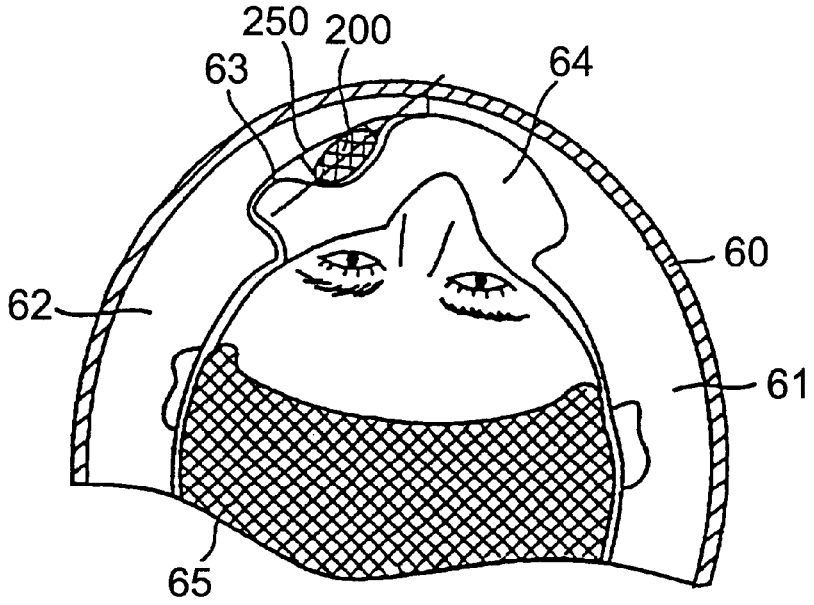
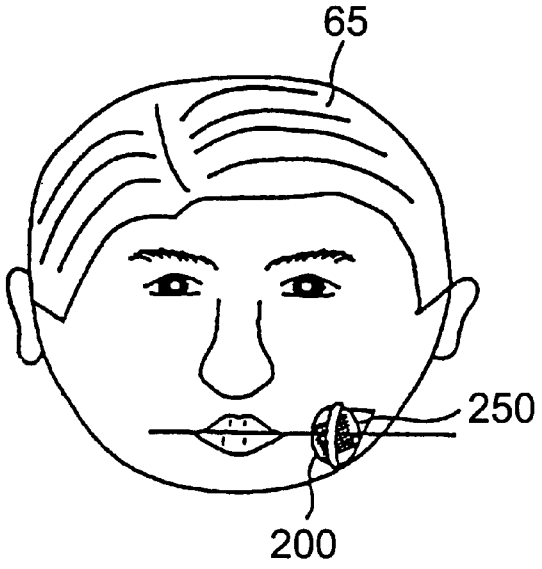
FIG. 2

FIG. 3
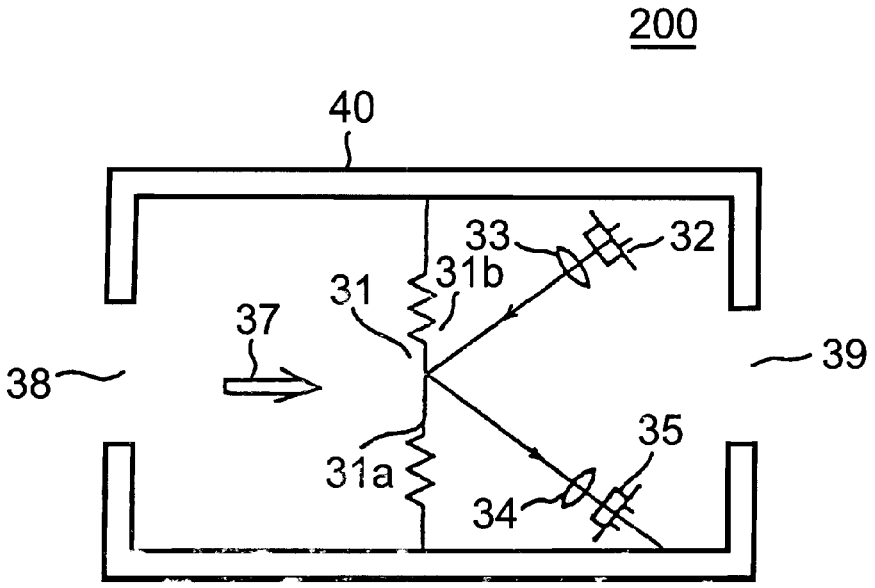
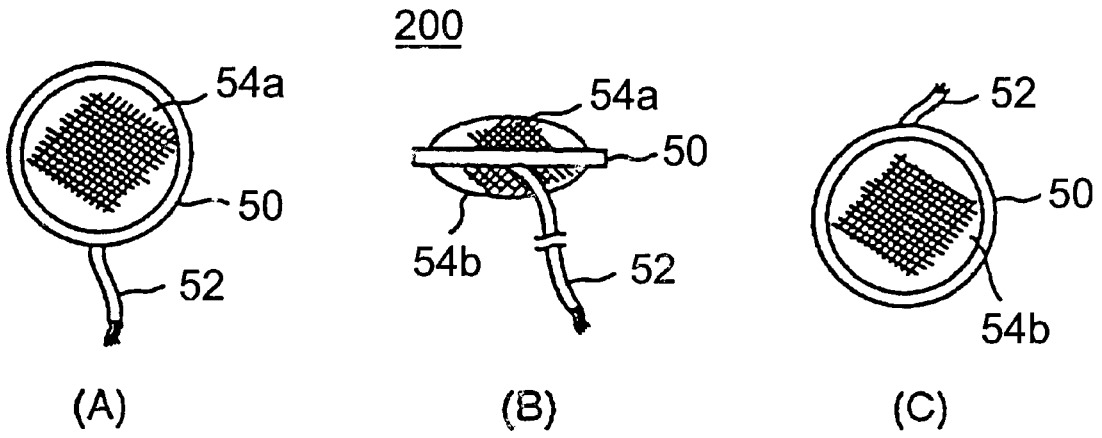
FIG. 4

COMMUNICATION HELMET

CROSS-REFERENCES TO RELATED APPLICATIONS

International Publication No.: WO 01/28280
International Application No.: PCT/JP00/07168
International Application Date: Oct. 16, 2000 (Oct. 16, 2000)
Priority No.: Japanese Patent Application No. 11-294220
Priority Date: Oct. 15, 1999 (Oct. 15, 1999) JP

BACKGROUND OF THE INVENTION

1. Technical Field

This invention relates in a helmet for communication, and it is related to the helmet for communication in which an optical microphone is built.

2. Description of the Related Art

To perform a communication in the situation that a helmet is worn, a microphone for the communication mounted inside the helmet may be used. As this type of microphone for communication, a close-speak type microphone and bone conduction type microphone, and so on are known. At any rate, a microphone that may decrease an outside noise is required.

FIG. 9 shows the section structure of the helmet to explain the wearing state of the conventional microphone for communication. Inside structure of the helmet 60 is formed so that a head 65 may be fixed firmly by the right chin liner 61 and a left chin liner 62. Around the mouth, a space (cavity) 64 is formed, and this cavity 64 is partitioned by cloth 63. Then, when a close speak type microphone 71 is used, it is fixed on the front of the mouth firmly, and mounted so that the microphone 71 may receive the voice of the speaking person through the cavity 64. When a bone conduction type microphone 72 is used, it was installed in the location where it stuck to the head 65 firmly in a part of the right chin liner 61 or the left chin liner 62, and mounted to transfer the voice conveyed by the bone conduction in the microphone 72.

Like this, with the helmet containing the conventional microphone, the microphone of the close speak type is fixed on the close location to the mouth in order not to be affected by the influence of the noise of the surroundings and to improve S/N ratio, or to pick out the sound wave by bone conduction in order not to pick out the noise of the surroundings.

However, with the conventional microphone stated above, the decrease of the noise depends on the wearing state of the microphone and the effect on a noise decrease is limited. With the conventional helmet for communication shown in FIG. 9, the noise decrease level was no more than 6–7 dB. It is an object of this invention to solve the problem, by drastically raising a noise decrease level, to provide a communication helmet comprising a microphone that has high sensitivity and wide-band even when the noise level of the surroundings is high.

BRIEF SUMMARY OF THE INVENTION

The helmet for communication in this invention is a helmet that installed microphone inside the helmet so that it may be located in the neighborhood of the mouth of the speaker, wherein the microphone is an optical microphone comprising, a diaphragm which oscillates by the sound pressure, a storage container that stores the diaphragm and has a first opening and a second opening provided in a symmetrical location and confronting the diaphragm, a light source which irradiates a light beam in the diaphragm, and a photodetector which receives a reflection light of the light beam irradiated in the diaphragm and outputs the signal coping with the oscillation of the diaphragm, wherein the optical microphone installed on a mount being slanted by a predetermined angle with the mount so that an arrival sound wave may enter equally in the first opening and the second opening, and wherein the mount is installed to have a space so that an outside sound wave may enter equally in the first opening and the second opening. The helmet for communication of this invention may further comprise an angle alignment means that varies an installation angle between the optical microphone and the mount. In the helmet for communication of this invention, the mount may be installed to be parallel with the optical microphone.

BRIEF DESCRIPTION OF THE DRAWINGS

FIG. 1 shows a section structure of the helmet for communication of this invention.

FIG. 2 shows a location of the optical microphone used for this invention relative to the speaking person.

FIG. 3 shows a structure of the optical microphone used for this invention.

FIG. 4 shows an appearance figure of the optical microphone device used for this invention.

Figure 5:
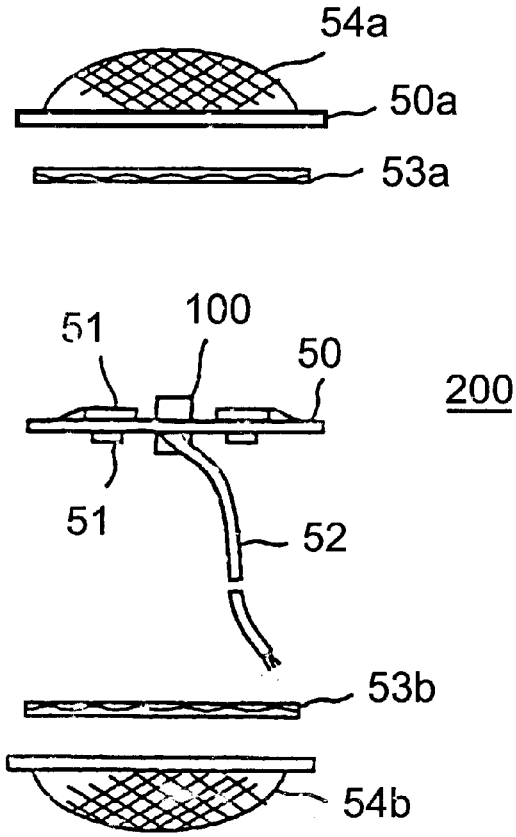
FIG. 5 shows a decomposition figure that shows the internal structure of the optical microphone device used for this invention.

In these figures, 31 is diaphragm, 32 is light source, 35 is photodetector, 38 is the first opening, 39 is the 2nd opening 40, storage container, 50 is substrate, 54 is cover, 200 is optical microphone, and 250 is mount.

DESCRIPTION OF THE SPECIFIC EMBODIMENTS

The microphone installed on a helmet for communication in this invention is an optical microphone, and it is a close speak type microphone. Therefore, this optical microphone must be mounted so that it may be located in the neighborhood of the mouth of a speaking person. FIG. 1 shows the section configuration of the helmet for the communication of this invention. At the front portion of chin liner 61, 62, a space (cavity) is formed to install an optical microphone 200 that is put on a mount 250. Next, an optical microphone used for this invention is explained by using FIG. 3–FIG. 7. FIG. 3 shows a structure of a head part of the optical microphone 200 to use for this invention. In the optical microphone to be used in this invention, a diaphragm 31 that oscillates by a sound wave 37 is provided in the central part of a storage container 40. Then, a 1st opening 38 and a 2nd opening 39 are provided on both sides of the storage container in symmetrical locations and faces a diaphragm 31. In this structure, a sound wave may enter through both openings into the storage container 40 and oscillate the diaphragm 31.

Inside the head 40 is divided to a portion facing a surface 31*a* and another portion facing a surface 31*b* opposite to the surface 31*a*. In the portion facing the surface 31*b*, a light source 32 such as LED irradiating a light beam in the surface 31*b* of the diaphragm 31 from a slant, a lens 33 to make a light beam from this light source 32 a predetermined beam diameter, a photodetector 35 which receives a reflection light reflected in the surface 31*b*, and a lens 34 to zoom a displacement of an optical path of the reflection light caused by the oscillation of the diaphragm 31 are provided. In this structure, when a sound wave hits the surface 31*a* and 31*b* of the diaphragm 31, and the diaphragm 31 oscillates, a receiving position of the receiving surface 35*a* of the reflection light changes. If the photodetector 35 is composed as a position sensor, an electric signal that met the oscillation of the diaphragm 31 from the irradiation location of the reflection light is taken out.

As stated above, in the optical microphone shown in FIG. 3. When a sound pressure of a sound wave from the 1st opening 38 and that from the 2nd opening 39 are equal, these two sound waves never oscillate a diaphragm 31 as they interfere each other on both sides 31*a* and 31*b* of the diaphragm 31. When two microphones that have equal sensitivities are arranged close and they receive sound wave which occurred in a far range, the two microphones detect the sound wave equally.

Figure 7:
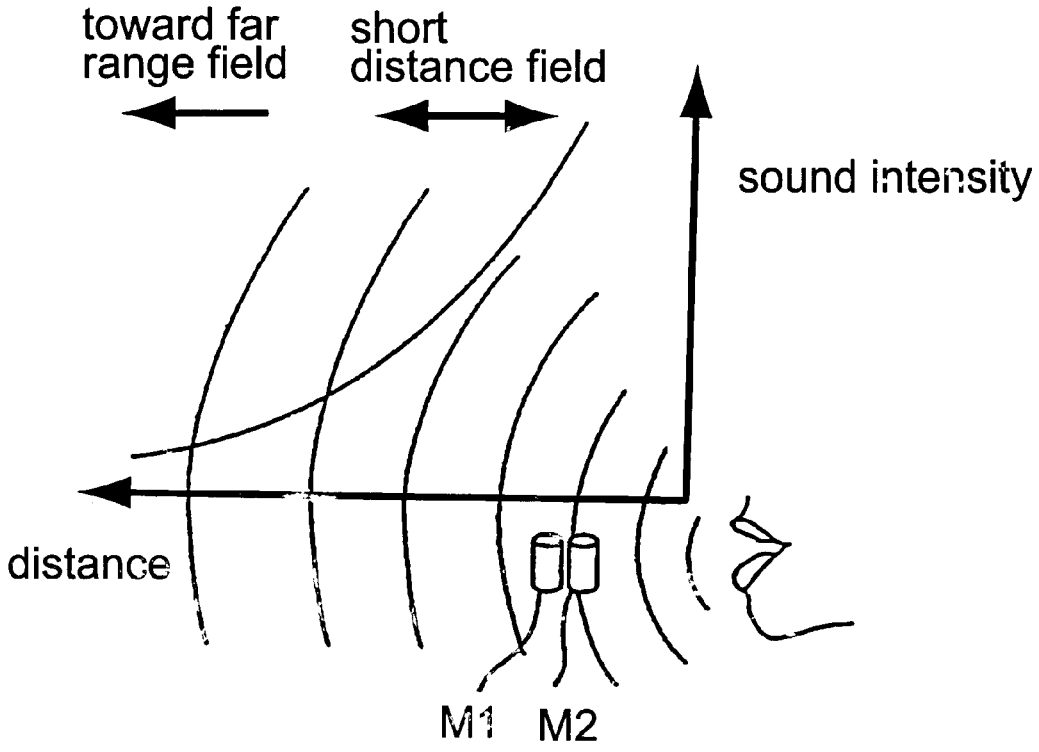
FIG. 7 shows a figure to explain the sound intensity on the position where microphone is put in the short distance field and in the far range field.

FIG. 7 shows a characteristic curve of the distance vs. sound intensity from the sound source. Generally, as shown in the figure, a sound wave occurs from the mouth of the person in a short distance from microphone element. In other words, most voice occurs at the short distance from this microphone element.

The voice of the person of this short distance has globular field characteristics so that it may be shown by a circular curve. On the other hand, the sound wave that occurs in the far range such as the sound wave by the noise has the characteristics of the plane field. Although the sound intensity of the globular wave is about the same along the spherical surface or the envelope and changes along the radius of that glob, the sound intensity of the plane wave almost becomes the same at all the points.

Optical microphone shown in FIG. 3 can be thought to associate two microphones. Therefore, when this was put on the far range field, the sound waves which have almost the same intensity and phase characteristics from the 1st opening 38 and the 2nd opening 39 comes in the diaphragm 31, to interfere with each other, and those influences are decreased. On the other hand, as a sound wave from the short distance field enters from the 1st opening 38 and the 2nd opening 39 non-uniformly, a sound wave from the short distance field oscillates a diaphragm 31, and it is taken out as a signal by the photodetector 35.

Figure 6:
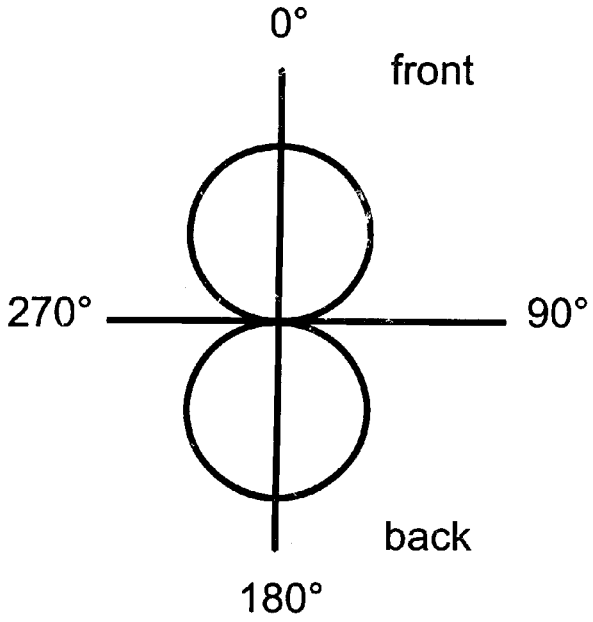
FIG. 6 shows a directivity response pattern figure of the sensitivity of the optical microphone.

FIG. 6 shows the directivity response pattern of the sensitivity of the optical microphone shown in FIG. 3. The optical microphone shown in FIG. 3 has almost "8" shaped symmetrical directivity comprising a pattern in the front face direction to go to the 1st opening 38 and a pattern in the back-plane direction to go to the 2nd opening 39. When the optical microphone shown in FIG. 3 is used, noise such as surroundings noise is imputed as sound from the far range field as shown in FIG. 7. In this case, as the sound wave enters equally from the 1st opening 38 and the 2nd opening 39 and interferes on the diaphragm 31 to extinct, a diaphragm 31 is never oscillated.

On the other hand, voice from the speaking person is inputted as sound from the short distance field. Therefore, reception sensitivities in two microphone elements M1, M2 are different to each other as shown in FIG. 7. Id est, the sound which enters from the 1st opening 38 and the sound from the 2nd opening 39 are different in intensity, and a diaphragm 31 is oscillated. Thus an optical microphone which decreased the influences of the noise can be realized.

FIG. 4 is an appearance figure which shows the point part configuration of the optical microphone device which the optical microphone 200 in FIG. 3 was carried on. FIG. 4A shows a front view, FIG. 4B shows a side elevation view, and FIG. 4C shows a rear view. FIG. 5 is the decomposition figure that shows internal structure. Referring to FIG. 4 and FIG. 5, the configuration of the optical microphone device using an optical microphone is explained. The optical microphone 200 shown in FIG. 3 is put almost on the center of the printed board 50. The optical microphone 200 is put on the printed board 50 so that the 1st opening 38 may face upward and the 2nd opening 39 may face downward. In this structure, the optical microphone 200 achieve the directivity response pattern of the equal sensitivity in top and bottom as shown in FIG. 6.

An off site circuit 51 to drive this optical microphone 200 is arranged on both surface of the printed board 50 to surround the optical microphone 200. To the substrate 50, cable 52 for microphone output and powering is connected. The printed board 50 with sponges 53*a*, 53*b* on top and bottom is covered by a net-shaped cover 54*a*, 54*b*. By fixing this, the optical microphone device is made. When the optical microphone device is put in the far range field, a sound wave reaches a diaphragm equally through the net cover 54*a*, 54*b*. When the optical microphone device is put in the short distance field, a sound wave enters unequally to oscillate the diaphragm and achieve amplification output.

Figure 8:
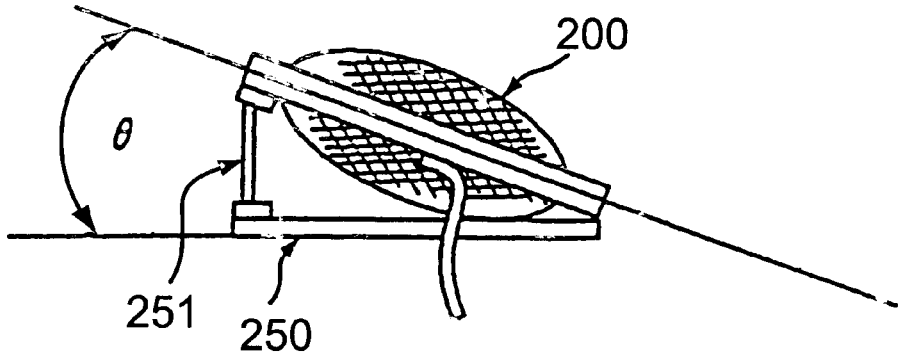
FIG. 8 shows a perspective view that shows installation to the mount of the optical microphone used for this invention.
Figure 9:
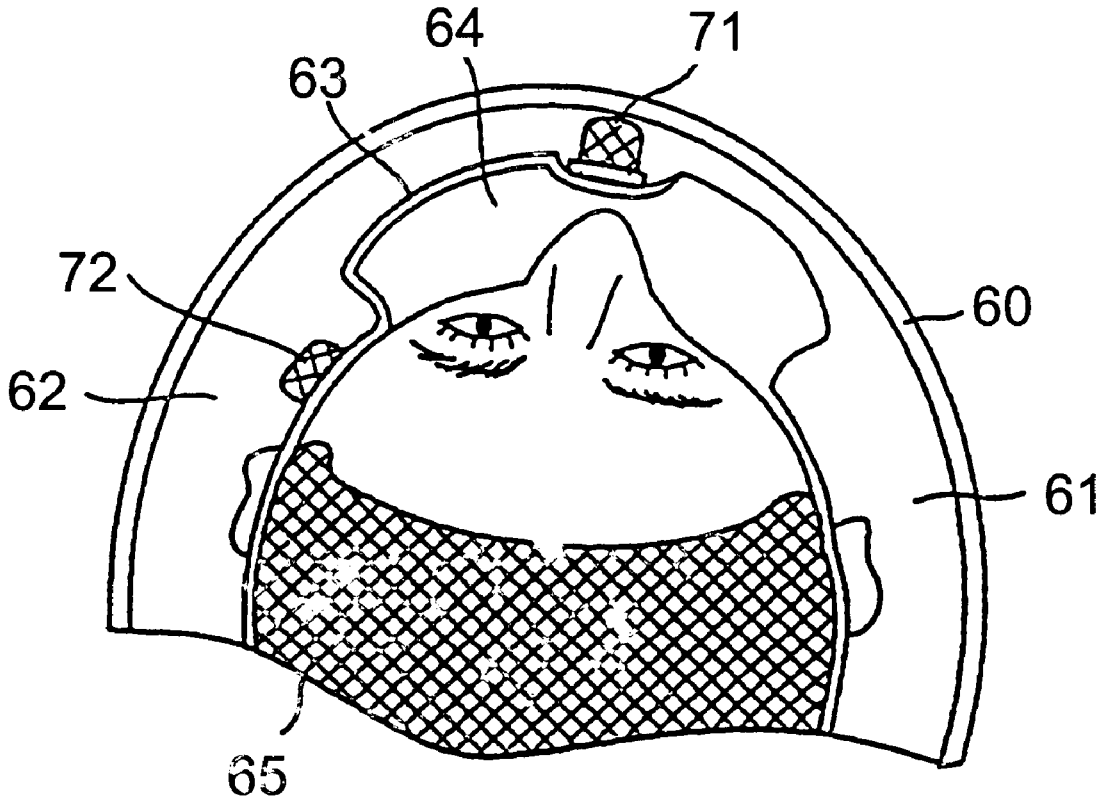
FIG. 9 (PRIOR ART)
FIG. 9 shows a sectional view of the helmet to explain the structure of the conventional helmet for communication.

FIG. 8 shows a perspective view which shows the state that optical microphone 200 is installed on the mount 250. Optical microphone 200 is installed to have an included angle $\phi$ to the mount 250 as shown in the figure. This included angle $\phi$ is set up so that an arrival sound wave may enter equally from the first opening and the second opening. By providing an angle alignment means 251 to vary the angle $\phi$, it is possible to achieve adjustment of the angle to decrease noise after wearing the helmet.

FIG. 2 shows the location of the optical microphone against the mouth of person. The optical microphone is preferably installed so that the mouth of the speaking person and the optical microphone may become parallel. By installing the microphone like this, the voice of the speaking person enters in un-equally from the first opening and the second opening of the optical microphone to oscillate a diaphragm and to be amplified and outputted. As for a noise, because it is the sound of the far range field, equivalent sound waves enter from the first opening and the second opening of the optical microphone, it is cancelled on the diaphragm, and a diaphragm is never oscillated. Therefore, it can reduce the influence of the noise.

In mounting the optical microphone 200 in the helmet, it is important to form a space (cavity) in the surroundings of the optical microphone 200 so that noise may enter equally in the first opening and the second opening in a predetermined angle $\phi$. On the helmet for communication of this invention, the noise decrease level was increased to 15–20 dB in comparison with a conventional 6–7 dB. Even under the environment that an ambient noise level is 120 dB, the voice of the speaking person was clearly picked up.

As explained above, the helmet for communication of this invention is a chin liner type and a cavity is composed in the off site part which optical microphone was installed with. In this construction, noise in the front direction and noise in the back-plane direction are canceled effectively, and a noise decrease level improves drastically even under an environment of high noise level. Aural intelligibility from the mouth improves by this, and good communication becomes possible.

What is claimed is:

1. A helmet for communication installed a microphone inside the helmet to be located in the neighborhood of the mouth of the speaking person;

wherein the microphone is an optical microphone comprising:

a diaphragm which oscillates by a sound pressure, a storage container that stores the diaphragm and has a first opening and a second opening provided in a symmetrical location and confronting the diaphragm, a light source which irradiates a light beam in the diaphragm, and a photodetector which receives a reflection light of the light beam irradiated in the diaphragm and outputs a signal that copes with the oscillation of the diaphragm;

wherein the optical microphone installed on a mount being slanted by a predetermined angle with the mount so that an arrival sound wave may enter equally in the first opening and the second opening;

wherein the mount is installed to have a space so that the sound wave may enter equally in the first opening and the second opening an angle alignment means that varies an installation angle between the optical microphone and the mount.

2. The helmet for communication according to claim 1, wherein the mount is installed so that the optical microphone and the mouth of the speaking person may be in parallel.

* * * * *